US006471371B1

(12) United States Patent
Kawashima et al.

(10) Patent No.: US 6,471,371 B1
(45) Date of Patent: Oct. 29, 2002

(54) DISPLAY LAMP

(75) Inventors: Tokio Kawashima; Akito Ikeda, both of Yao (JP)

(73) Assignee: Patlite Corporation, Osaka (JP)

( * ) Notice: Subject to any disclaimer, the term of this patent is extended or adjusted under 35 U.S.C. 154(b) by 0 days.

(21) Appl. No.: 09/580,732

(22) Filed: May 26, 2000

(30) Foreign Application Priority Data

May 31, 1999 (JP) ..... 11-152498

(51) Int. Cl.[7] ..... F21V 1/00

(52) U.S. Cl. ..... 362/235; 362/237; 362/238; 362/244; 362/249; 362/355; 362/800; 362/545

(58) Field of Search ..... 362/235, 237, 362/238, 244, 245, 249, 355, 800, 545

(56) References Cited

U.S. PATENT DOCUMENTS 4,929,866 A 5/1990 Murata et al.
5,054,885 A 10/1991 Melby
5,136,483 A 8/1992 Schoniger et al.
5,148,146 A 9/1992 Murphy
5,642,933 A 7/1997 Hitora
5,769,532 A 6/1998 Sasaki

*Primary Examiner*—Sandra O'Shea
*Assistant Examiner*—Ali Alavi
(74) *Attorney, Agent, or Firm*—Koda & Androlia

(57) ABSTRACT

A display lamp in which the front face of a non-display portion (2*a*) is surrounded by a globe (5, 5A) serving as a display portion and in which a light source (4) is disposed inside of the space defined by the globe (5, 5A) and the non-display portion (2*a*). The light source (4) comprises at least a pair of left and right LEDs (42, 43) disposed at both sides which sandwich the transverse center of the front face of the non-display portion (2*a*). The LEDs (42, 43) respectively irradiate lights to those zones of the globe (5, 5A) which are located in the opposite sides with respect to the LEDs (42, 43) on the basis of the transverse center of the globe (5, 5A). Preferably, the pair of LEDs (42, 43) comprises a pair of left- and right-side end LEDs (42, 43) disposed at the left- and right-side ends or their vicinities of the front face of the non-display portion (2*a*).

10 Claims, 11 Drawing Sheets

DISPLAY LAMP

BACKGROUND OF THE INVENTION

1. Field of the Invention

The present invention relates to a display lamp using LEDs as a light source and arranged to diffuse and emit lights efficiently from the inside of a globe serving as a display portion.

2. Description of Related Art

As a display lamp such as a signal informing display lamp or the like, a display lamp using LEDs as a light source is conventionally widely used at a factory production line, a variety of entrances and exits for which attention should be called, a construction site or the like. Such a display lamp does not require frequent change of a bulb as done with a conventional incandescent lamp source, and is resistant against external factors such as vibration and the like.

As an example of the display lamp of this type, there is a display lamp having a display portion to be installed on a wall face and arranged to emit light forward or obliquely forward of the wall face.

For example, in a display lamp 90 shown in FIG. 13, a globe 92 having an arcuate section covers the front of a flat-type rear plate 91 of a case to be attached onto a wall face. A plurality of LEDs 94 are arranged on a substrate 93 attached, in parallel, to the rear plate 91. Each of the LEDs 94 irradiates light toward the zone just in front of the globe 92

On the other hand, a display lamp 90 shown in FIG. 14 uses a substrate 93 made in the form of a curve similar to that of a globe 92. Each of LEDs 94 irradiates light radially in the normal-line direction of the globe 92, i.e., toward the zone in close vicinity to the globe 92.

The display lamp 90 in each of FIGS. 13 and 14 has a short distance between each LED 94 and the zone to be irradiated of the globe 92 (equivalent to the optical path length between the light emission of each LED 94 and the light irradiation onto the globe 92). Particularly, in the arrangement in FIG. 14, the distance between the substrate 93 and the globe 92 is short and the optical path length above-mentioned is therefore particularly short.

When the optical path length is short, the light from each LED 94 cannot sufficiently be diffused before the light reaches the globe 92. This narrows that zone of the globe 92 to be illuminated by each LED 94. Accordingly, to irradiate light to the globe 92 in its entirety to improve the visibility, it is required to use a number of LEDs 94.

SUMMARY OF THE INVENTION

It is an object of the present invention to provide a display lamp arranged to efficiently utilize the lights from LEDs, enabling the number of the LEDs to be reduced, yet assuring the visibility.

The present invention provides a display lamp in which the front face of a plane non-display portion is surrounded by a globe, as a display portion, vertically extending and having an arcuate cross section or a polygonal cross section when combined with the non-display portion, and in which a light source is disposed inside of the space defined by the globe and the non-display portion. In the display lamp according to the present invention, the light source comprises at least a pair of left and right LEDs disposed at both sides which sandwich the transverse center of the front face of the non-display portion. These LEDs respectively irradiate lights to those zones of the globe which are located in the opposite sides with respect to the LEDs on the basis of the transverse center of the globe.

According to the arrangement above-mentioned, for example the LED disposed at the left side irradiates light toward the zone at the right side of the globe. Accordingly, a long distance can readily be assured as the distance required for light diffusion. This results in expansion of the area of the globe zone to be irradiated by the light from each LED. It is therefore possible to illuminate the whole globe with the number of LEDs reduced.

The at least a pair of left and right LEDs may comprise a pair of left- and right-side end LEDs disposed at the left and right ends or their vicinities of the front face of the non-display portion. Preferably, the pair of left- and right-side end LEDs respectively irradiate lights to those parts of the globe which are respectively opposite to the right- and left-side end LEDs as separated from each other with the largest distance provided therebetween. According to the arrangement above-mentioned, the distance required for diffusion of the light from each end LED can securely be maximized.

Preferably, the light source comprises a center LED which is disposed at the transverse center of the non-display portion and which irradiates light to the transverse center and its vicinity of the globe.

The lights from the end LEDs are generally directed to the peripheral edge parts of the globe. Accordingly, there are instances where the amount of light to be irradiated to the globe center is insufficient. In this connection, when the center LED is disposed, the light can sufficiently be irradiated to the center and its vicinity of the globe.

Instead of the center LED, or in addition to the center LED, there may be disposed reflection means for reflecting portions of the lights from the pair of left and right LEDs to the transverse center and its vicinity of the globe. According to the arrangement above-mentioned, the reflection means can sufficiently irradiate such light portions to the transverse center and its vicinity of the globe. When the reflection means is disposed instead of the center LED, the number of the LEDs can further be reduced.

There may be disposed, on the non-display portion, reflection means for reflecting portions of the lights from the pair of left and right LEDs toward those zones of the globe which are located in the same sides with respect to the LEDs in the transverse direction.

According to the arrangement above-mentioned, the lights from the LEDs are irradiated to the zones which are located not only in the opposite sides, but also in the same sides. Further, because the optical paths can be bent by reflection, there can be provided such optical path lengths as to assure sufficient light diffusion. As a result, even in the case of light irradiation to the zones at the same sides, the irradiation area can be expanded. This results in further expansion of the area to be irradiated by the light from each LED.

The reflection means may be formed by the surface of a portion of a case which supports the globe. According to this arrangement, the integration of the reflection means with a portion of the case can simplify the structure of the display lamp. Further, because such integration eliminates the labor of assembling the reflection means with the case, the assembling is facilitated.

The case may comprise a pair of end members which hold the upper and lower ends of the globe, and a post member which connects the pair of end members to each other. In this case, the reflection means is preferably formed on a surface of this post member. According to this arrangement, the post member can reinforce the connection of the end members to each other, and the structure can be simplified in that the reflection means is formed on a surface of the post member.

These and other features, objects and advantages of the present invention will be more fully apparent from the following detailed description set forth below when taken in conjunction with the accompanying drawings.

DESCRIPTION OF THE PREFERRED EMBODIMENTS

Figure 1:
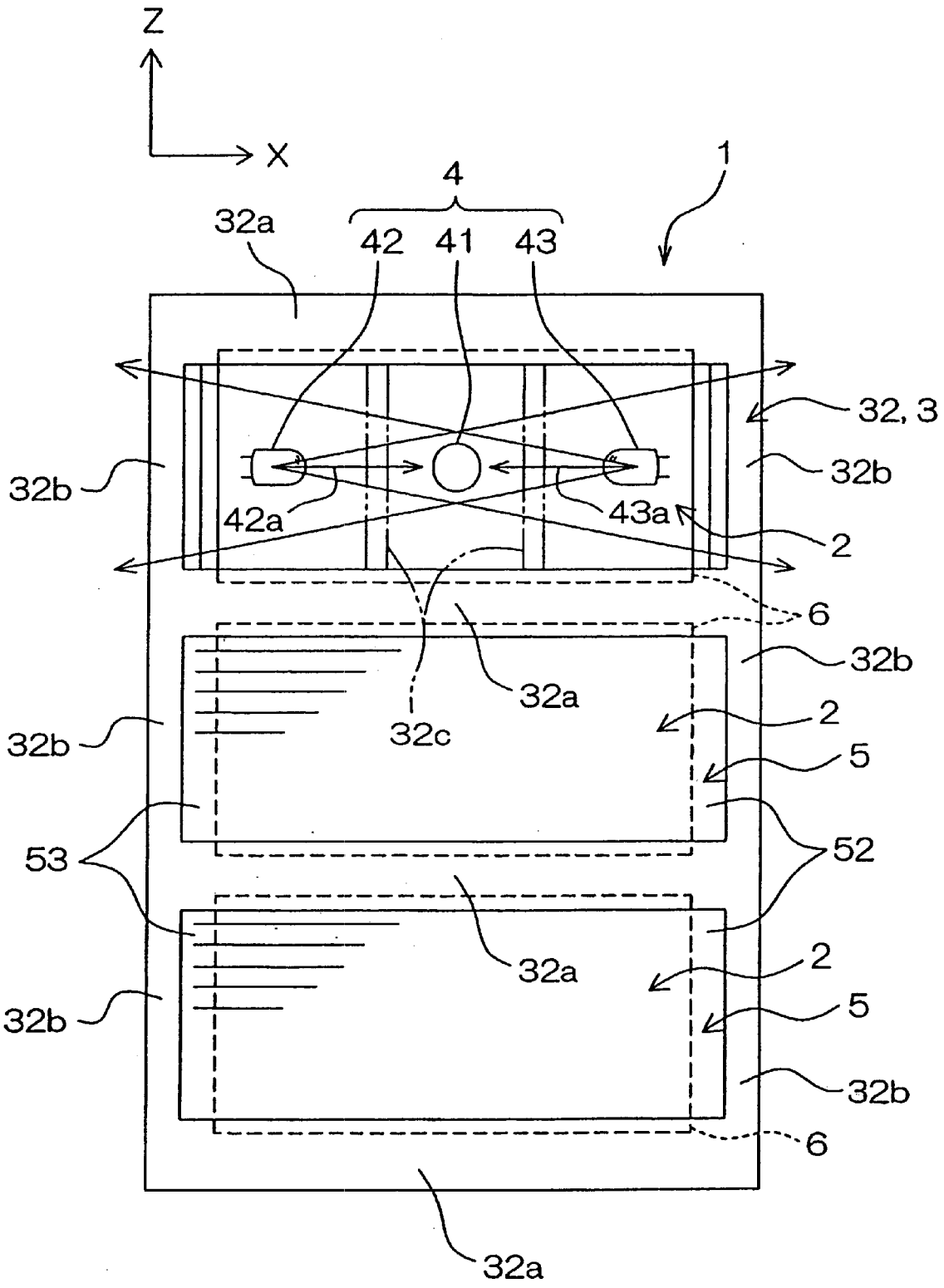
FIG. 1 is a front view of a signal display apparatus according to a first embodiment of the present invention.
Figure 2:
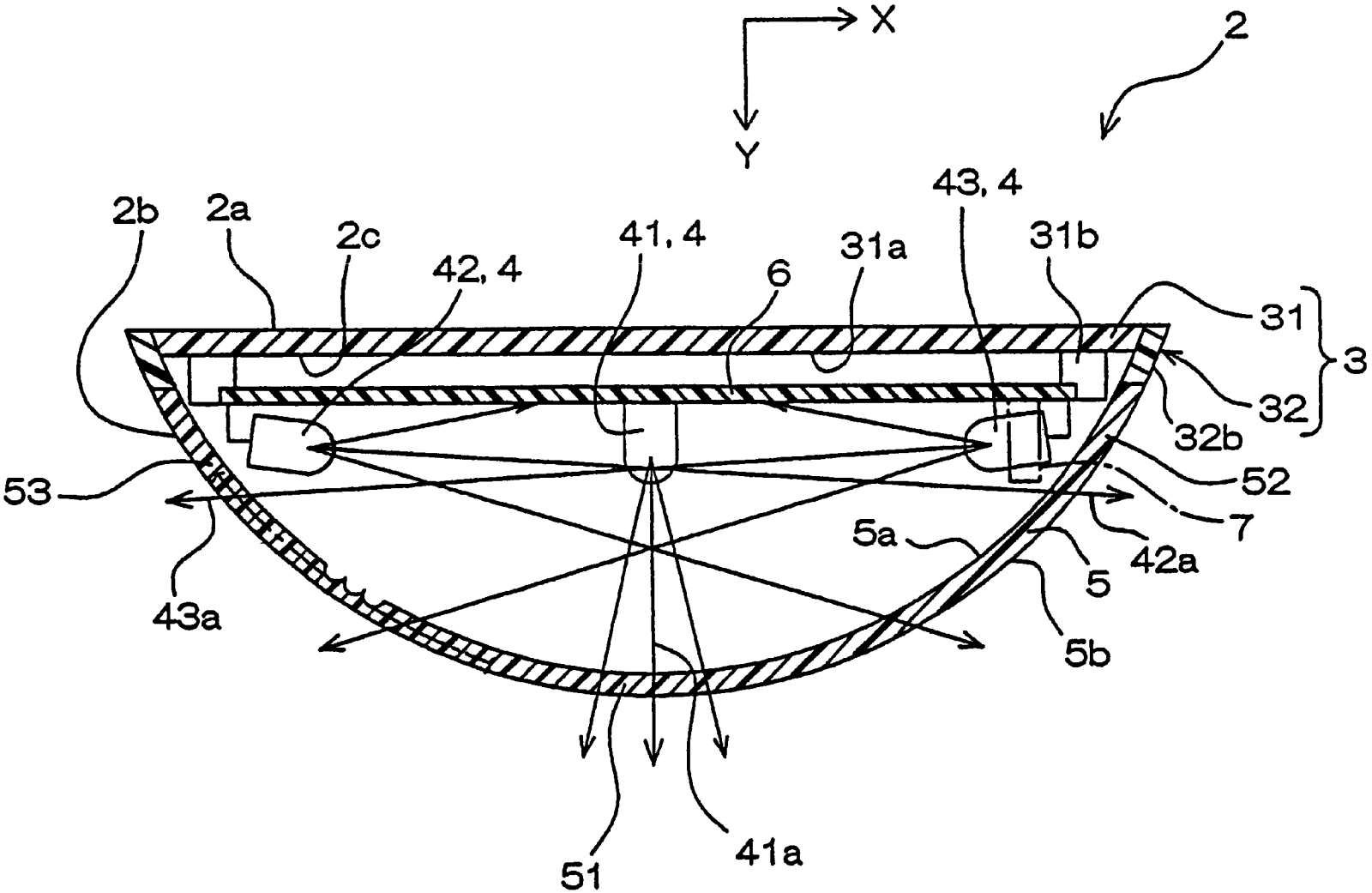
FIG. 2 is a section view in plan elevation of the signal display apparatus shown in FIG. 1.

FIG. 1 is a front view of a signal display apparatus according to a first embodiment of the present invention. FIG. 2 is a section view in plan elevation of the signal display apparatus in FIG. 1. In each of FIGS. 1 and 2, there are shown, as necessary, an arrow X indicating the transverse direction, an arrow Y indicating the longitudinal direction and an arrow Z indicating the vertical direction.

As shown in FIG. 1, a signal display apparatus 1 has a case 3 which forms the outer shape of the apparatus 1. In the case 3, there are vertically disposed, in lamination, a plurality of display lamps 2, e.g., three display lamps 2, each arranged to emit light and display a signal.

As shown in FIG. 2, each display lamp 2 is provided at the rear side thereof with a plane-shape non-display portion 2*a*, and has a display portion 2*b* which surrounds the front face 2*c* of the non-display portion 2*a*. A light source 4 is disposed in the space defined by the display portion 2*b* and the non-display portion 2*a*, the light source 4 comprising a plurality of light emitting diodes (LED). The display portion 2*b* is formed by a light-transmitting globe 5 which transmits light from the light source 4 to the outside. The non-display portion 2*a* is formed by a rear case 31 of the case 3. The light source 4 is attached to the rear case 31 through a substrate 6.

The colors of the lights emitted from the respective light sources 4 vary with the display lamps 2. Accordingly, when the light source 4 of the desired display lamp 2 emits light, it is possible to emit signal light in color according to the color of this light source 4.

According to the first embodiment, the light source 4 of each display lamp 2 comprises at least a pair of left and right LEDs 42, 43 disposed at both sides of the front face 2*c* of the non-display portion 2*a* which sandwich the transverse center of the front face 2*c*. These LEDs 42, 43 are arranged to respectively irradiate lights to those zones of the globe 5 which are located in the opposite sides with respect to the LEDs 42, 43 with respect to the transverse center of the globe 5. This expands the globe area to be irradiated by the light from each LED, thus enabling the number of LEDs to be reduced, yet assuring sufficient visibility.

The light source 4 comprises the pair of left and right end LEDs 42, 43 above-mentioned, and a center LED 41 disposed at the transverse center of the front face 2*c* of the non-display portion 2*a*.

As shown in FIG. 1, the center LED 41 is disposed substantially at the center of the globe 5 in front elevation. As shown in FIG. 2, the center LED 41 is disposed on the rear side within the inside space of the display lamp 2 in plan elevation such that there is provided a predetermined distance between the center LED 41 and the inner surface of the globe 5. The center LED 41 is attached to the substrate 6 such that its light projecting axis 41*a* is at a right angle to the substrate 6. When the center LED 41 emits light in the forward direction, the light irradiates the transverse center and its vicinity of the globe 5. Here, the light projecting axis refers to the direction in which the LED light intensity is maximized, and is determined according to the arrangement of the LED.

The end LEDs 42, 43 are disposed at positions in close vicinity to the left and right ends of the non-display portion 2*a*. Further, the end LEDs 42, 43 are disposed substantially at the center in the vertical direction of the non-display portion 2*a*. The light projecting axes 42*a*, 43*a* of the end LEDs 42, 43 extend horizontally and are inclined forward at a predetermined angle with respect to the transverse direction in plan elevation. The end LEDs 42, 43 are attached to the substrate 6 and arranged such that their light projecting axes 42*a*, 43*a* pass through those right- and left-side ends 52, 53 of the globe 5 which are opposite to each other as separated from each other with the largest distance provided therebetween, out of the respective parts of the globe 5. To set, with high precision, the angles of the light projecting axes 42*a*, 43*a* of the end LEDs 42, 43, the substrate 6 may have posture holding members 7 for holding, on the substrate 6, the LEDs 42, 43 at predetermined postures.

The globe 5 is made of a light-transmitting material such as a methacrylic resin, glass or the like, and is transparent with or without color. When the globe 5 is to be colored, it is better to use the color of the LED lights. This can emphasize the lights from the LEDs. For example, the LED lights are red, the globe 5 is colored in red.

The globe 5 is made in the form of a vertically extending trough which is arcuate in cross section and which projects the most forward at the transverse center portion 51. The globe 5 transmits lights through the peripheral surface thereof to the forward and to the oblique forward (in the angle range of about 180° in the forward direction). The globe 5 is made in the form of a rectangle long in the transverse direction in a front view. The globe 5 is provided at the inner peripheral surface 5*a* thereof with a number of diffusion lenses in the form of vertically extending longitudinal ribs. Further, the globe 5 is provided on the outer peripheral surface 5*b* with a number of diffusion lenses in the form of peripheral ribs (See FIG. 3).

As shown in FIG. 1, each substrate 6 is made in such size as to cover substantially the whole front face of each non-display portion 2*a*. Each substrate 6 is disposed for each display lamp. Each substrate 6 is connected, through a pair of connectors 61, to a lead line 62 (See FIG. 3) by which there is conducted signal transmission for power feed, lighting-up or lighting-out. There may be used a single substrate 6 in a unitary structure for a plurality of display lamps 2. In this case, the assembling can be facilitated.

Figure 3:
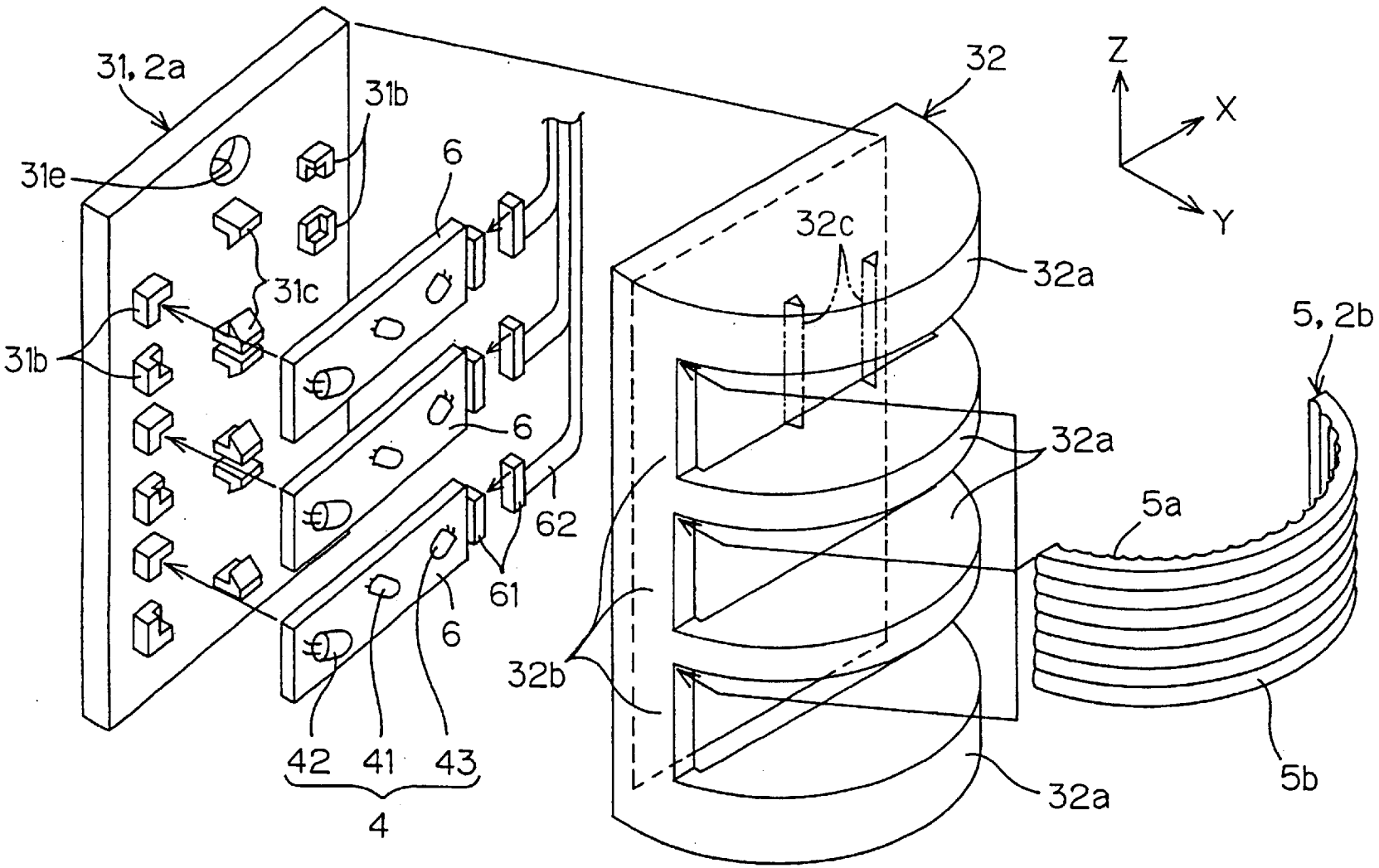
FIG. 3 is an exploded perspective view of the signal display apparatus in FIG. 1.

As shown in FIG. 3, the case 3 comprises (i) the plate-like rear case 31, as the non-display portion 2*a*, to the front face of which each substrate 6 is attached, and (ii) a frame-like front case 32 attached to the front face of the rear case 31. Each of the front case 32 and the rear case 31 is made of a non-light-transmitting material.

The rear case 31 is provided, on the front face 31*a* thereof at its positions corresponding to the display lamps 2, with (i) positioning portions 31*b* which come in contact with the four corners of the substrates 6, and (ii) pairs of hooks 31*c* which hook the peripheral portions of the substrates 6. By fitting the four corners of the substrates 6 to the positioning portions 31*b* and by hooking the peripheral portions of the substrates 6 by the hooks 31*c*, the substrates 6 can readily and securely be positioned and fixed to the predetermined positions of the rear case 31. To attach the substrates 6 to the rear case 31, there may be used other known means such as screws or the like. The rear case 31 is provided in an upper portion thereof with a hole 31*e* through which the lead lines 62 pass. This hole 31*e* may be formed in a lower portion of the rear case 31.

The front case 32 comprises (i) a plurality of, for example four, partition plates 32*a* serving as end members which are disposed at upper, lower and intermediate positions, and (ii) three pairs of post members 32*b* which connect the left ends of the partition plates 32*a* to each other and also connect the right ends of the partition plates 32*a* to each other. Each globe 5 is fitted into the space between adjacent partition plates 32*a*, thus forming a space for housing the light source 4 and the like of each display lamp 2. This space is opened at its rear, and each rear opening is covered by the rear case 31 and each substrate 6. Each of the partition plates 32*a* has a cross-sectional shape identical with that of each globe 5, for example a semi-circular shape. The front end edges of adjacent partition plates 32*a* hold the upper and lower ends of the globe 5 disposed between these adjacent partition plates 32*a*. The peripheral portion of each globe 5 is waterproofed with a sealing member (not shown).

The following description will discuss the operation of each display lamp 2.

As shown in FIG. 2, the light from the center LED 41 is directly irradiated to the center portion 51 and its vicinity of the globe 5 from the immediate rear. The light from the left-side end LED 42 is spread inside of the display lamp 2 and directly irradiated to the right-side end 52 and its vicinity of the globe 5. Likewise, the light from the right-side end LED 43 is directly irradiated to the left-side end 53 and its vicinity of the globe 5. The lights are directly irradiated to the globe 5. Accordingly, higher visibility can be assured as compared with the case of irradiation of reflected lights which are readily attenuated.

The light from each of the LEDs 41, 42, 43 is spread in plan elevation as shown in FIG. 2, and is also spread in the vertical direction as shown in FIG. 1. The peripheral portions of the lights thus spread are irradiated also to those zones of the globe 5 between the center portion 51 and each of the right- and left-side ends 52, 53. Thus, the lights are uniformly irradiated substantially to the whole peripheral surface of the globe 5. Then, the lights are diffused by the diffusing lenses of the globe 5 and emitted uniformly in all the directions.

According to the arrangement above-mentioned, as shown in FIG. 2, the end LEDs 42, 43 irradiate lights to those zones of the globe 5 which are located in the opposite sides with respect to the LEDs 42, 43 with respect to the transverse center of the globe 5. This enables the distance necessary for light diffusion to be sufficiently lengthened. This results in expansion of the globe area to be irradiated by the lights from the end LEDs 42, 43. It is therefore possible to reduce the number of the LEDs required for irradiating the whole globe 5, yet assuring the visibility.

In particular, the pair of end LEDs 42, 43 are disposed in close vicinity to the left- and right-side ends of the front face 2*c* of the non-display portion 2*a*, and respectively irradiate lights to those right- and left-side ends 52, 53 of the globe 5 which are opposite to each other as separated from each other with the largest distance provided therebetween. This enables the distance necessary for diffusion of the light from each end LED 42, 43 to be securely lengthened substantially up to the maximum length. This substantially maximizes the globe 5 area to be irradiated by the light from each LED. More preferably, the pair of end LEDs 42, 43 are disposed at the left- and right-side ends of the front face 2*c* of the non-display portion 2*a*.

The lights from the end LEDs 42, 43 are generally directed to the right- and left-side ends 52, 53. Accordingly, there are instances where the amount of light irradiated to the center portion 51 is insufficient. In this connection, this embodiment is arranged such that the center LED 41 irradiates light sufficiently to the center portion 51 and its vicinity of the globe 5. This assures the visibility at the center portion 51 and in its turn the whole globe 5.

Figure 4:
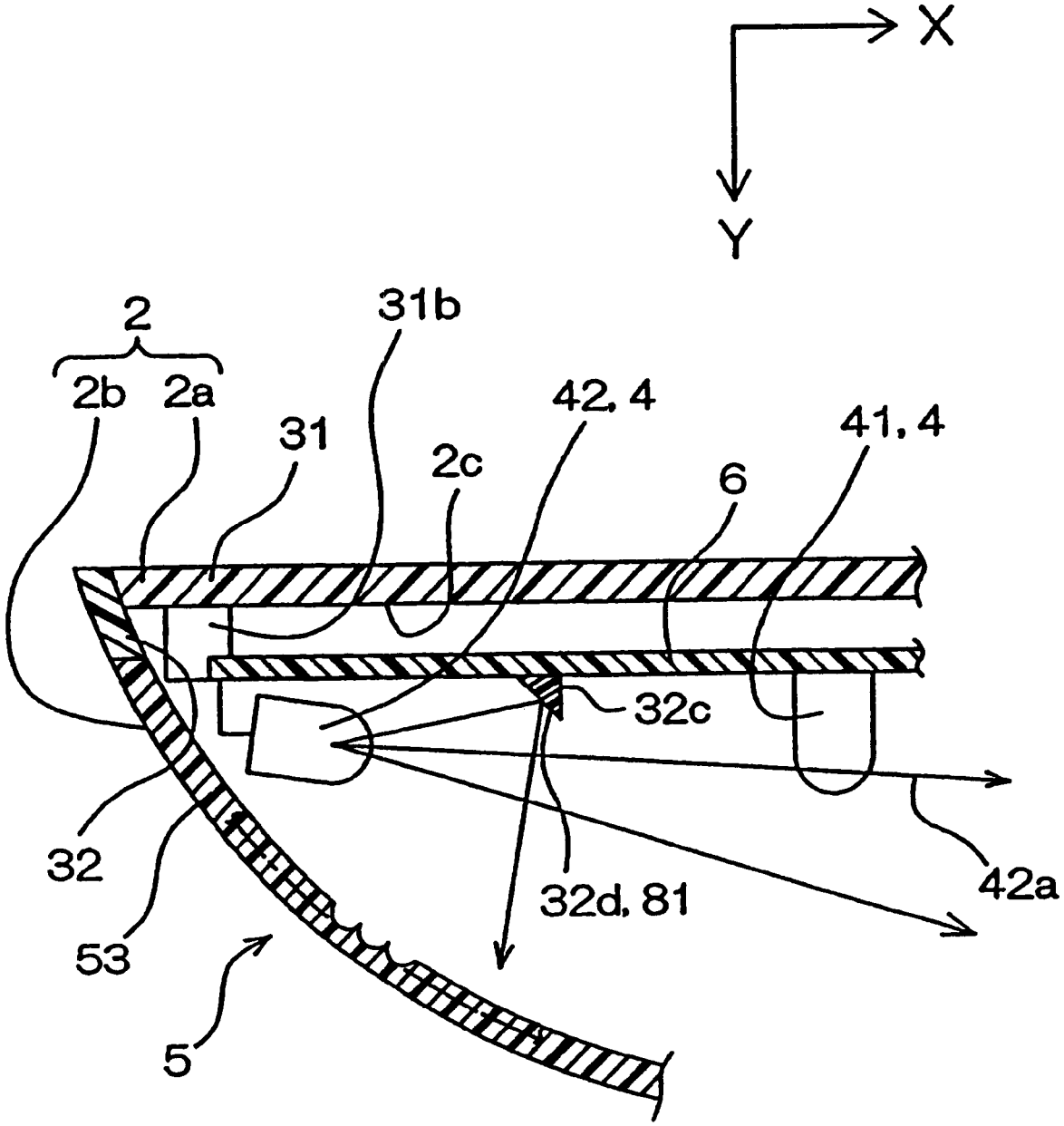
FIG. 4 is an enlarged section view in plan elevation of portions of the signal display apparatus according to a second embodiment of the present invention.

The following description will discuss a second embodiment of the present invention. In the following, like parts already discussed are designated by like reference numerals used in previous figures, and the description thereof will be omitted. The following description will be made with reference to FIG. 4 in addition to FIGS. 1 and 2

In the display lamp 2 according to the second embodiment, reflection means 81 are disposed at the non-display portion 2*a* for reflecting the lights from end LEDs 42, 43. More specifically, the reflection means 81 are disposed at the rear parts of the front case 32 attached to the rear case 31 which forms the non-display portion 2*a*.

The front case 32 has, in addition to the partition plates 32*a* and post members 32*b* above-mentioned, vertically extending post members 32*c* (also shown two-dot-and-dashed lines in FIGS. 1 and 3) which connect the rear parts of adjacent partition plates 32*a* to each other. These post members 32*c* reinforce the connection of adjacent partition plates 32*a*. The post members 32*c* are disposed in the form of pairs at positions between the transverse center and each of the transverse ends of the front case 32.

The post members 32*c* are disposed as extending along the front face of the substrate 6 such that the forefronts of the post members 32*c* deviate from the light projecting axes 42*a*, 43*a* of the end LEDs 42, 43. This does not obstruct the irradiation of the lights from the end LEDs 42, 43, to the right- and left-side ends 52, 53 of the globe 5.

Each of the post members 32*c* has a triangular section and is disposed a little to each end LED 42, 43. Each of the post members 32*c* has an inclined face 32*d* which is oblique in the transverse and longitudinal directions. The left post member 32*c* has the inclined face 32*d* at the left side, while the right post member 32*c* has the inclined face 32*d* at the right side.

The reflection means 81 comprise the inclined faces 32*d* of the pair of post members 32*c*, and there is formed, on each inclined face 32*d*, a reflective member such as an aluminium-metallized film or the like. For example, the left inclined face 32*d* receives a portion of the light from the end LED 42, for example a light portion directed to the substrate 6, and then reflects this light portion toward that part of the globe 5 which is located in the same side in the transverse direction with respect to the end LED 42, for example a part between the left-side end 53 and the center portion 51.

The second embodiment having the arrangement above-mentioned produces the following operational effects in addition to the operational effects produced by the first embodiment. That is, the lights from the end LEDs 42, 43 are irradiated by the reflection means 81 also to those zones of the globe 5 at the same sides in the transverse direction thereof with respect to the end LEDs 42, 43, while maintaining, substantially as they are, the light irradiation areas in those zones of the globe 5 at the opposite sides with respect to the end LEDs 42, 43 in the transverse direction. Further, because the optical paths are bent by reflection, sufficient lengths necessary for light diffusion can be assured even for the optical path lengths of light irradiations to the same sides with respect to the end LEDs 42, 43. As a result, the area to be irradiated by the light of each LED can further be expanded. Accordingly, light can sufficiently be irradiated to those parts of the globe 5 which are supposed to be insufficient in light amount. Thus, the visibility can be assured.

The reflection means 81 are disposed at the oblique rears of the end LEDs 42, 43. It is therefore possible to reflect and utilize the light portions which are otherwise directed, in vain, toward the non-display portion 2*a*.

Further, the integration of the reflection means 81 with the case 3 simplifies the structure of the display lamps 2. Further, because such integration eliminates the labor of assembling the reflection means 81 with the case 3, the assembling is facilitated.

In particular, when the reflection means 81 are formed at the post members 32*c*, the post members 32*c* serve as reinforcing members and also as the reflection means 81. This further simplifies the structure.

Figure 5:
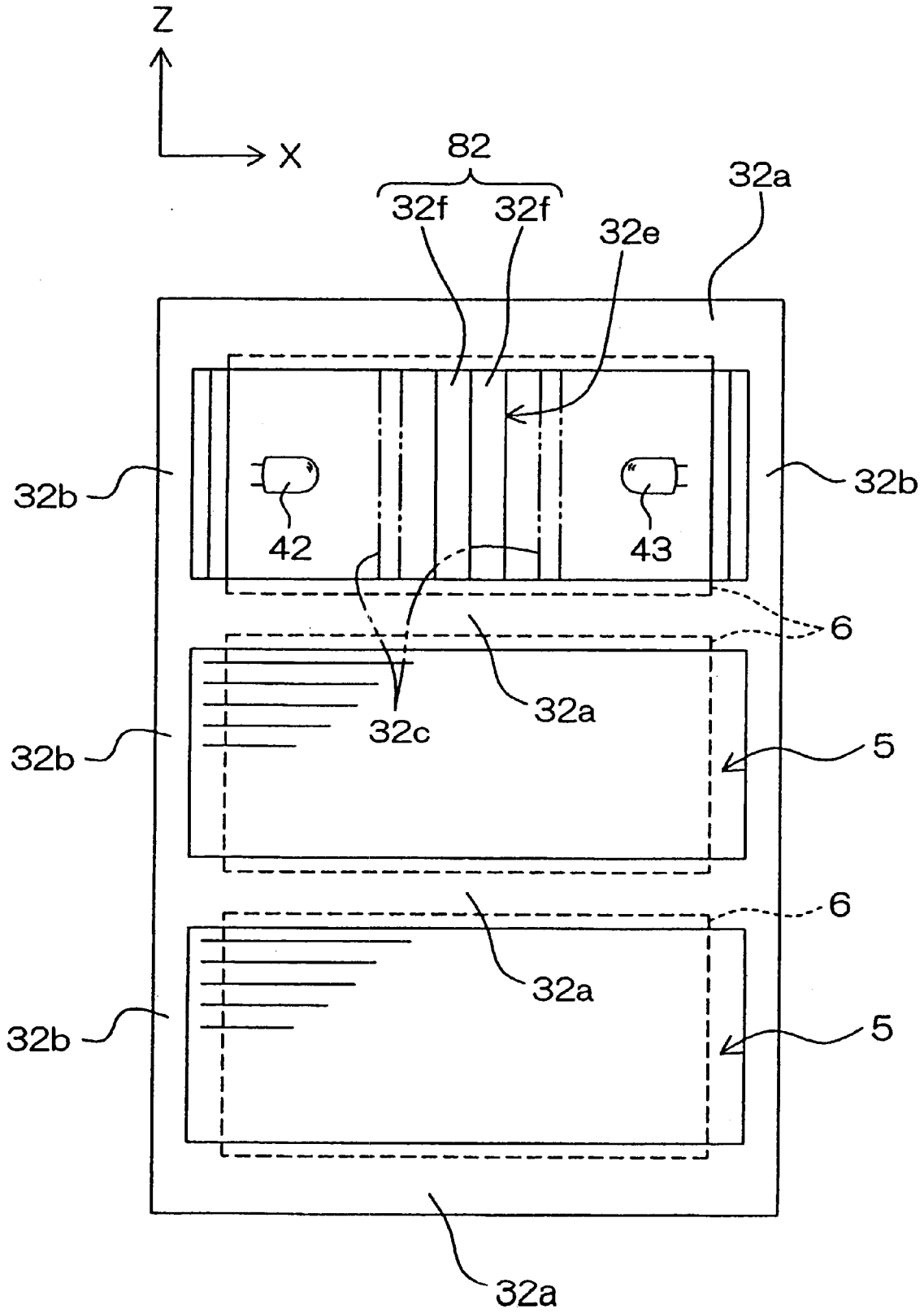
FIG. 5 is a front view of a signal display apparatus according to a third embodiment of the present invention.
Figure 6:
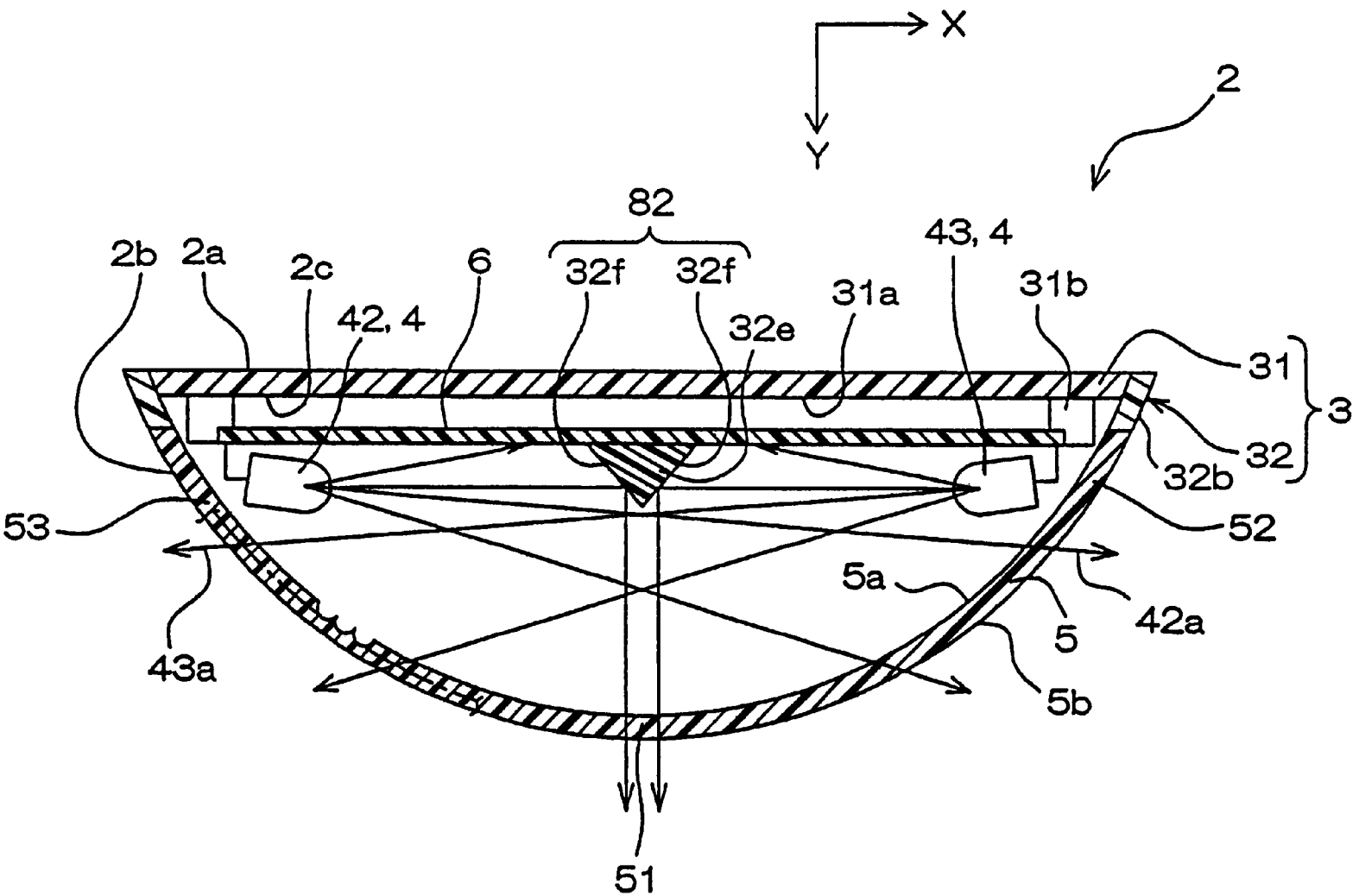
FIG. 6 is a section view in plan elevation of the signal display apparatus in FIG. 5.

With reference to FIGS. 5 and 6, the following description will discuss a third embodiment of the present invention.

According to the third embodiment, there is disposed, instead of the center LED 41 in the first embodiment, reflection means 82 for reflecting portions of the lights from the end LEDs 42, 43 toward the center portion 51 of the globe 5. This reflection means 82 is disposed at the non-display portion 2*a*. This reflection means 82 is formed at the back part of the front case 32 attached to the rear case 31 forming the non-display portion 2*a*.

The front case 32 has vertically extending post members 32*e* which connect the rear parts of adjacent partition plates 32*a* to each other. The post members 32*e* reinforce the connection of adjacent partition plates 32*a* to each other. Each of the post members 32*e* is disposed at the transverse center and has a pair of inclined faces 32*f* arranged at the left and right sides of the front face.

Each reflection means 82 comprises the pair of inclined faces 32*f* formed at the left and right sides of the front face of each post member 32*e*. A reflective member is formed on each inclined face 32*f*. The left inclined face 32*f* receives a portion of the light from the left-side end LED 42, for example a light portion irradiated substantially in parallel to the transverse direction, and reflects this light portion toward the center portion 51 and its vicinity of the globe 5 in the forward direction from the immediate rear. Likewise, a portion of the light from the right-side end LED 43 is reflected by the right inclined face 32*f* and irradiated toward the center portion 51 and its vicinity of the globe 5.

According to the third embodiment having the arrangement above-mentioned, portions of the lights of each pair of end LEDs 42, 43 are reflected by each reflection means 82 and irradiated to the center portion 51 and its vicinity of the globe 5.

Because the reflection means 82 are disposed, it is possible to bend the optical paths between the end LEDs 42, 43 and the center portions 51, causing the optical paths to be lengthened. This expands the irradiation areas of lights irradiated to the center portions 51. As a result, the end LEDs 42, 43 can be used for irradiating the lights not only to the left and right zones, but also to the center portions 51.

Thus, the center LEDs 41 can be eliminated, yet securely assuring the visibility. This further reduces the number of LEDs in the whole display lamps. For example, only two end LEDs 42, 43 at the left and right sides are disposed for each display lamp.

Further, each reflection means 82 comprises a part disposed at the oblique rears of the end LEDs 42, 43. Accordingly, light portions which are otherwise directed, in vain, toward the non-display portions 2*a*, can also be reflected and effectively utilized.

In addition to the operational effects above-mentioned, the third embodiment can produce the operational effects produced by the first embodiment, except for that produced by each center LED 41. Likewise in the second embodiment, the integration of the reflection means 82 with the case 3 such as the post members 32*e*, not only facilitates the assembling, but also simplifies the structure.

Figure 7:
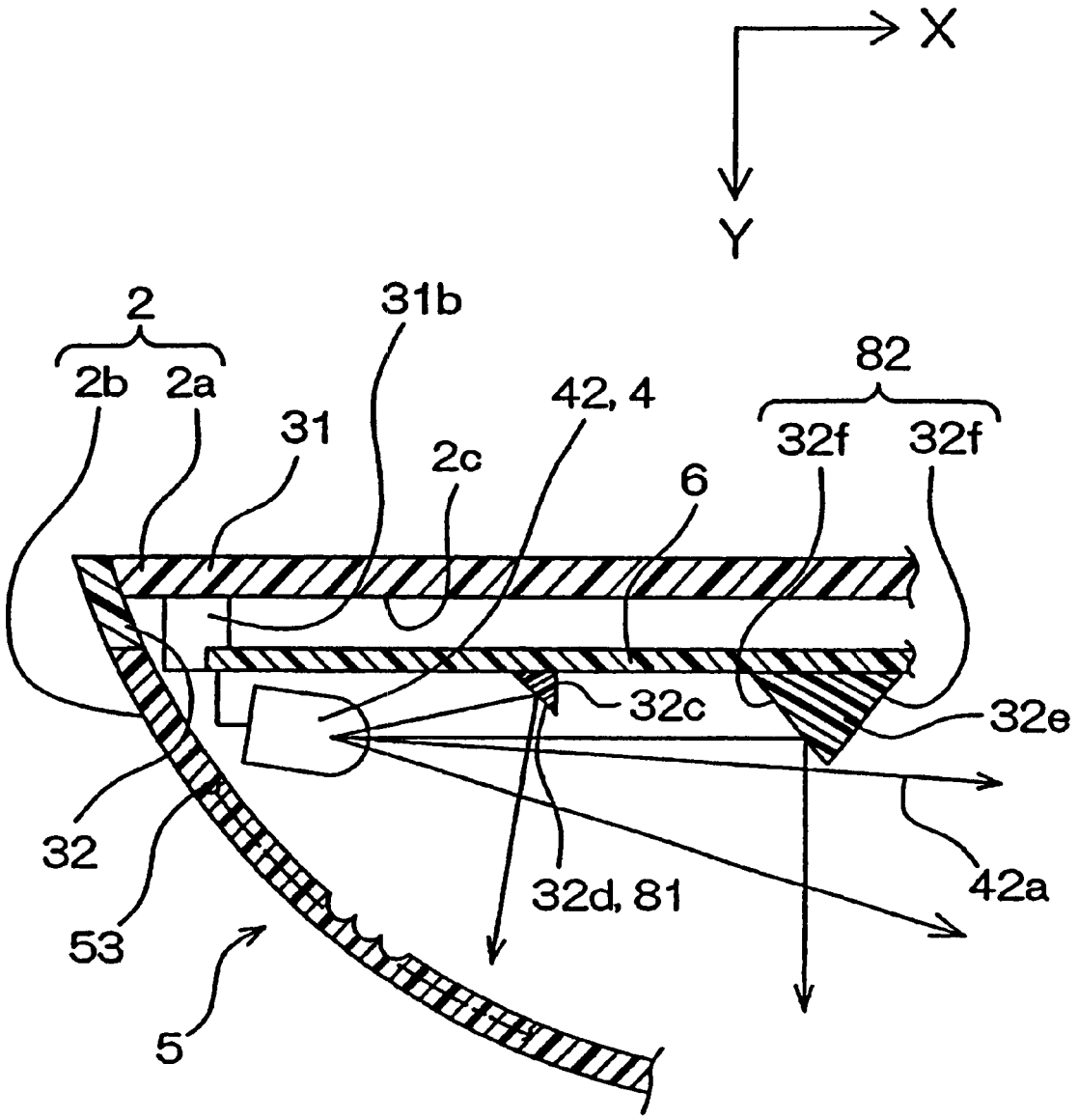
FIG. 7 is an enlarged section view in plan elevation of portions of a signal display apparatus according to a fourth embodiment of the present invention.

Like a fourth embodiment shown in FIG. 7, reflection means 81 may be added to the third embodiment. In this case, each post member 32*e* disposed at the center projects forward with respect to the post members 32*c* disposed at the left and right sides (also shown by the two-dot-and-dashed lines in FIG. 5). Out of the lights from the end LEDs 42, 43, the light portions directed in the obliquely rearward direction are reflected by the inclined faces 32*d* of the reflection means 81, and the light portions substantially in parallel to the transverse direction go over the post members 32*c* and are reflected by the inclined faces 32*f* of the reflection means 82.

The fourth embodiment having the arrangement above-mentioned produces both operational effects produced by the second and third embodiments. This further securely assures the visibility.

Figure 8:
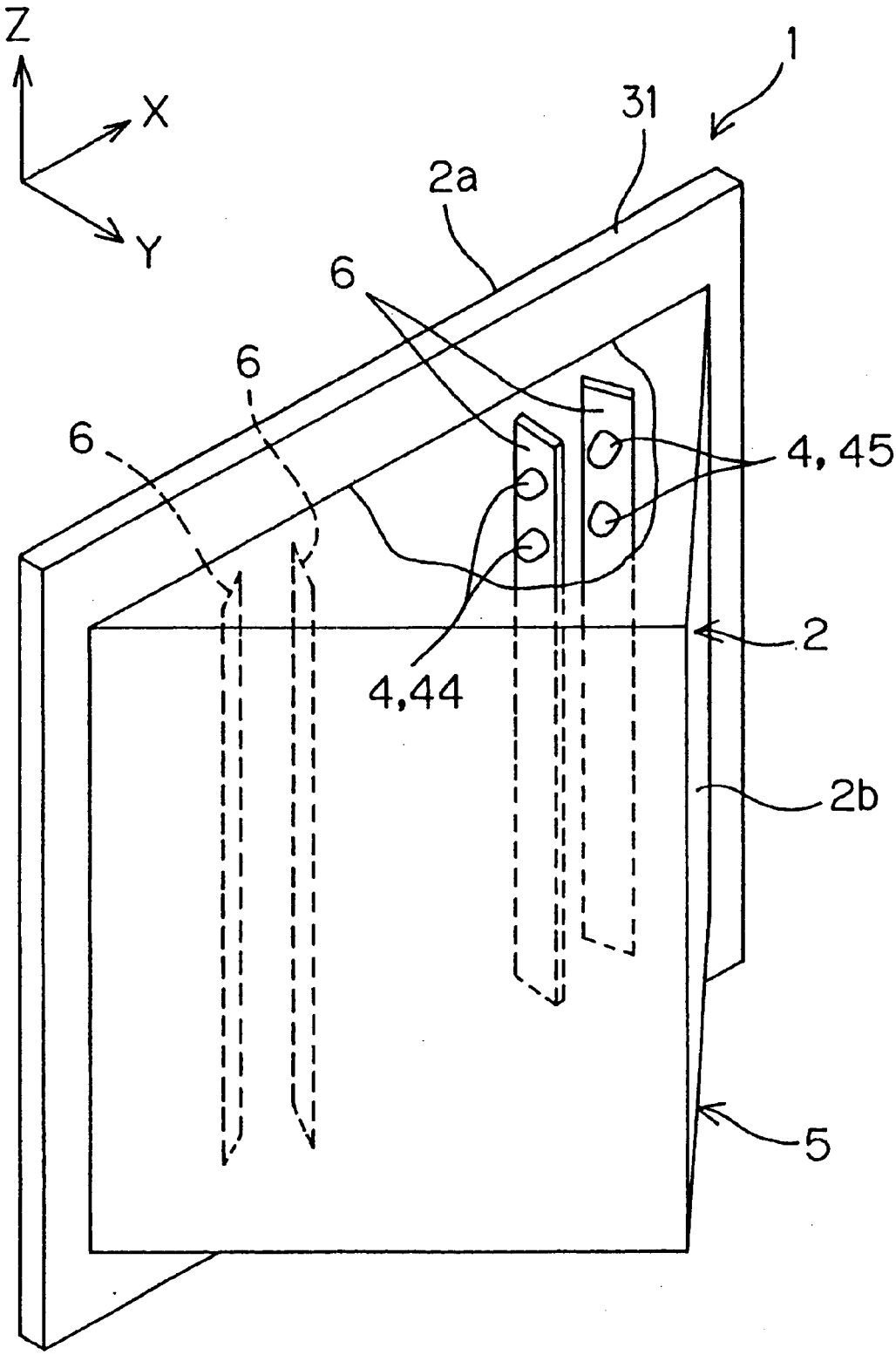
FIG. 8 is a perspective view, with portions shown in section, of a signal display apparatus according to a fifth embodiment of the present invention.

Like a fifth embodiment shown in FIG. 8, the signal display apparatus 1 may be formed by a single display lamp 2.

The display lamp 2 has a globe 5A having a triangular shape in cross section when combined with the rear case 31.

Thus, the cross-section shape of the globe may be not only circular, but also polygonal when the globe is combined with the case 3. The polygonal number may be four or more.

The light source 4 comprises two pairs of left and right LED groups 44, 45 at both sides which sandwich the transverse center of the front face of the non-display portion. Each of the LED groups 44, 45 comprises a plurality of vertically arranged LEDs and is attached to each substrate 6A which is long in the vertical direction.

Figure 10:
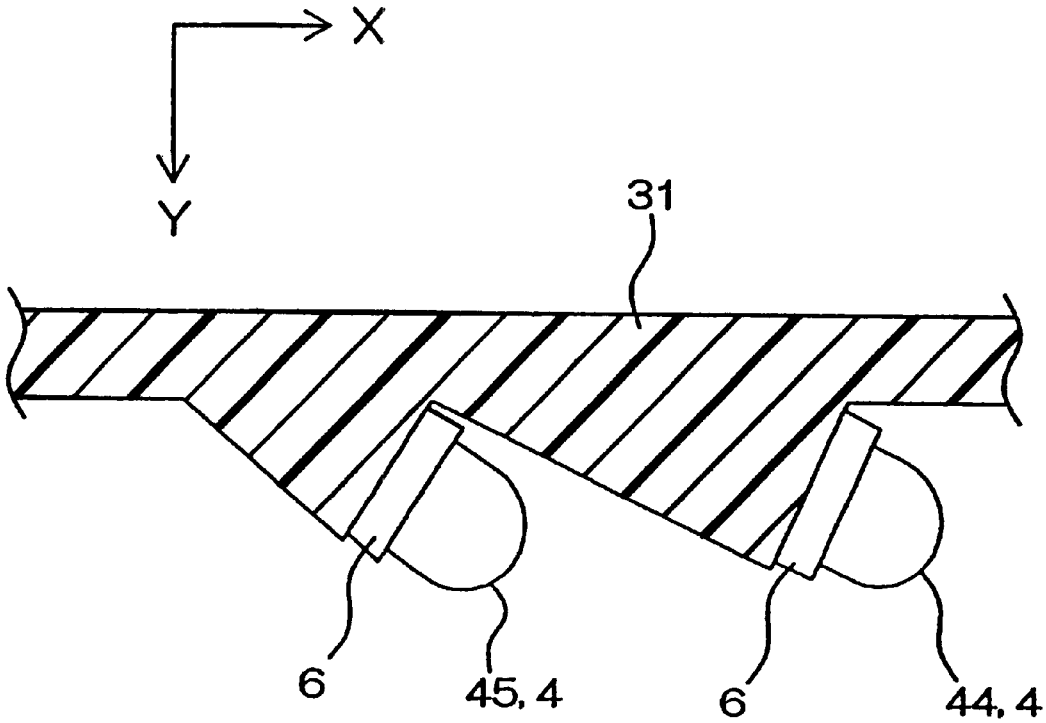
FIG. 10 is an enlarged plan view of a portion A in FIG. 9.

The substrates 6A are attached to inclined faces formed at the front faces of the rear case 31, and the angles of the inclined faces vary with the LED groups (See FIG. 10). The LEDs are secured to the substrates 6 such that the light projecting axes of the LEDs are at right angles to the surfaces of the substrates 6A. By inclining the substrates 6A in the manner above-mentioned, the LEDs can securely be inclined in predetermined directions. The LED groups 44, 45 are disposed at both sides which sandwich the transverse center of the rear case 31, i.e., substantially at the intermediate portions between the transverse center and each of the transverse ends.

Figure 9:
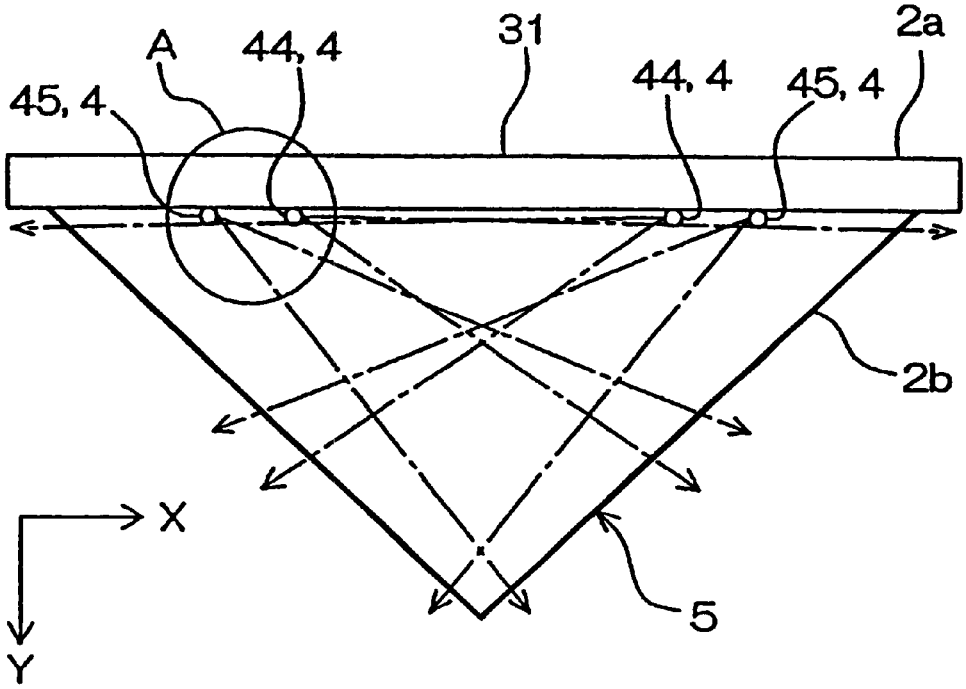
FIG. 9 is a plan view of the signal display apparatus in FIG. 8.

A pair of LED groups 45 disposed at the outer sides in the transverse direction, irradiate lights to parts of the globe 5A a little to the center thereof in the globe zones located in the opposite sides in the transverse direction (See FIG. 9). A pair of LED groups 44 disposed at the inner sides in the transverse direction, irradiate lights to parts of the globe 5A a little to the transverse ends thereof in the globe zones located in the opposite sides in the transverse direction (See FIG. 9).

Figure 11:
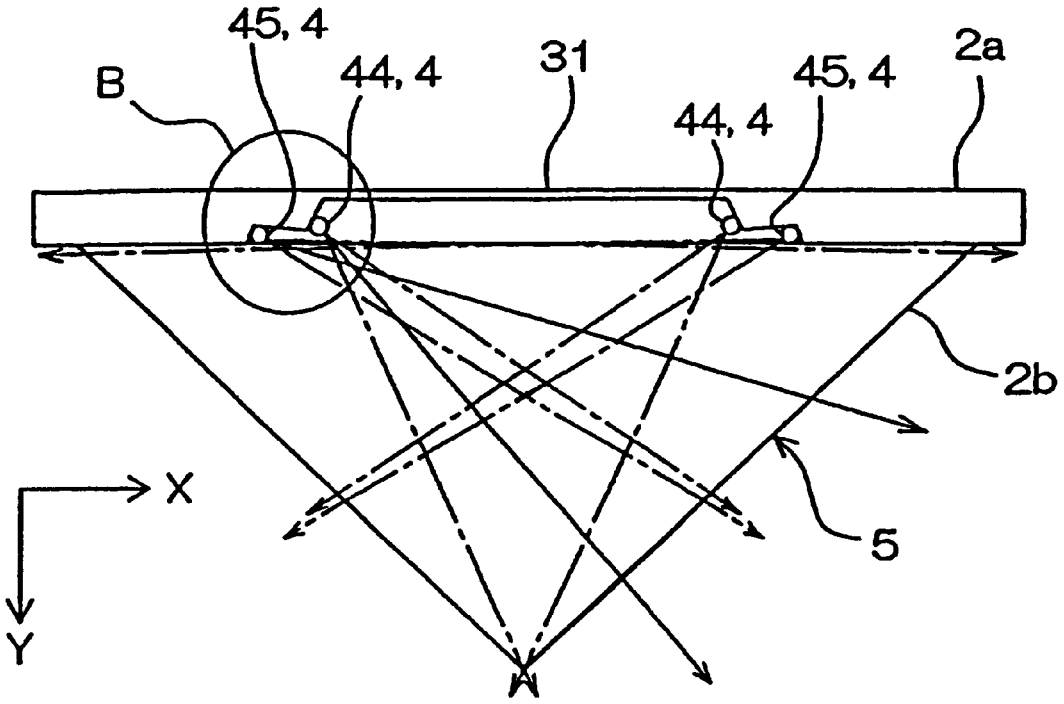
FIG. 11 is a plan view of a signal display apparatus according to a sixth embodiment of the present invention.
Figure 12:
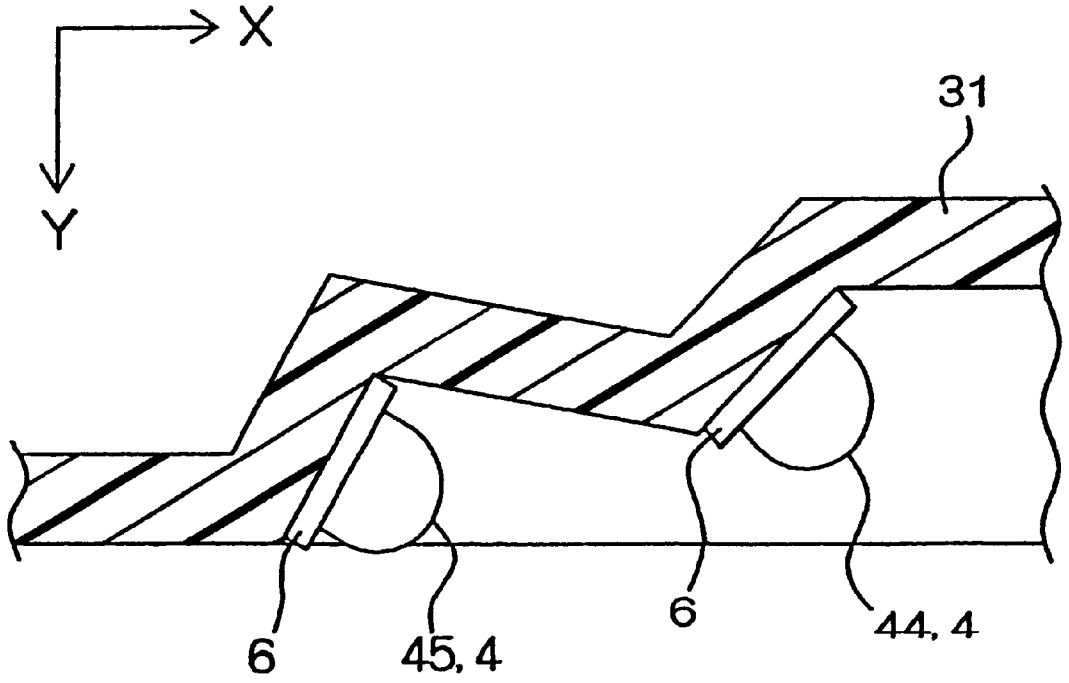
FIG. 12 is an enlarged plan view of a portion B in FIG. 11.
Figure 13:
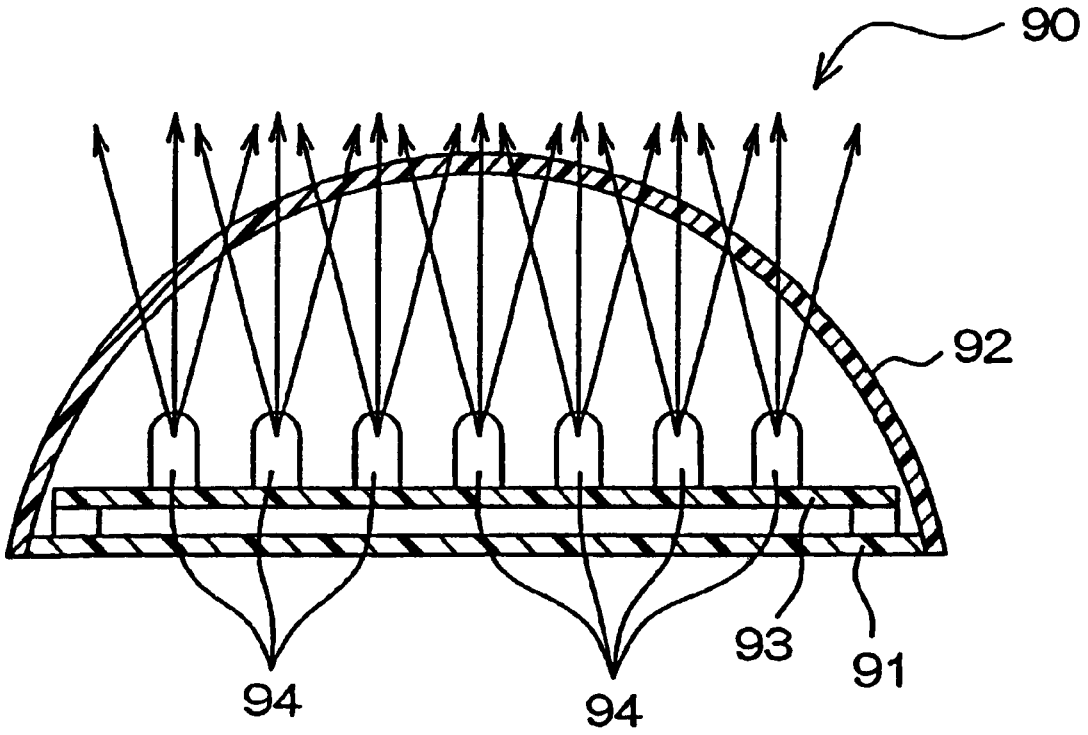
FIG. 13 PRIOR ART
FIG. 13 is a section view in plan elevation of a display lamp of prior art.
Figure 14:
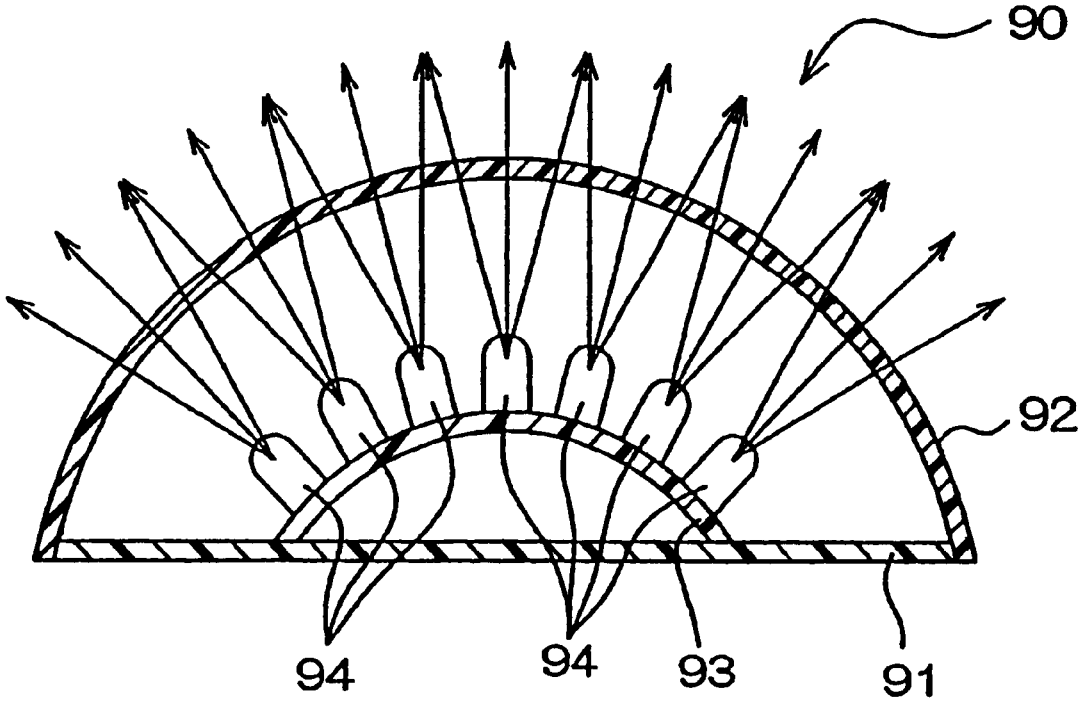
FIG. 14 PRIOR ART
FIG. 14 is a section view in plan elevation of another display lamp of prior art.

In a sixth embodiment shown in FIG. 11, a pair of LED groups 45 disposed at the outer sides in the transverse direction, irradiate lights to parts of the globe 5A a little to the transverse ends thereof in the globe zones located in the opposite sides in the transverse direction. A pair of LED groups 44 disposed at the inner sides in the transverse direction, irradiate lights to parts of the globe 5A a little to the center thereof in the globe zones located in the opposite sides in the transverse direction. The substrates 6A are attached to inclined faces inside of the concaves in tiers formed at the rear case 31 (See FIG. 12). Thus, the LEDs are disposed in the concaves in tiers. Accordingly, even though a number of LEDs are disposed, the LEDs hardly get in the way.

According to the embodiments above-mentioned, the display lamps 2 maybe installed in the postures or directions as shown in FIGS. 1 to 12, but may also be installed, as necessary, in postures or directions different from those shown in FIGS. 1 to 12. For example, the vertical direction above-mentioned may be changed to the transverse direction, and the front face above-mentioned may be turned up or down.

Each display lamp 2 in each of the embodiments above-mentioned, may be used for a signboard or an illumination lamp, in addition to a signal display apparatus.

Various embodiments of the present invention have been discussed in detail, but these embodiments are mere specific examples for clarifying the technical contents of the present invention. Therefore, the present invention should not be construed as limited to these specific examples. The spirit and scope of the present invention are limited only by the appended claims.

This application claims the conventional priority benefits of Japanese Patent Application Serial No. 11-152498, filed on May 31, 1999, the disclosure of which is incorporated herein by reference.

What we claim is:

1. A display lamp in which the front face of flat a non-display portion (2*a*) is surrounded by a light transmitting globe (5, 5A) serving as a display portion and in which a light source (4) is disposed inside of the space defined by the globe (5, 5A) and the non-display portion (2*a*), characterized in that:

said light source (4) comprises at least a pair of left and right LEDs (42, 43) disposed on opposite sides of a transverse center of said front face of said non-display portion (2*a*), said pair of left and right LEDs (42, 43) are disposed on said flat non-display portion (2*a*) and inclined away from said non-display portion (2*a*) toward said light transmitting globe (5, 5A), and said LEDs (42, 43) respectively irradiating lights to those zones of said globe (5, 5A) which are located on sides opposite to said LEDs (42, 43) with respect to the transverse center of said globe (5, 5A).

2. A display lamp according to claim 1, wherein said non-display portion (2*a*) is plane, and said globe (5, 5A) vertically extends and has an arcuate cross section or a polygonal cross section when combined with said non-display portion (2*a*).

3. A display lamp according to claim 1 or 2, wherein said at least a pair of left and right LEDs (42, 43) comprise a pair of left- and right-side end LEDs (42, 43) disposed at the left and right ends or their vicinities of said front face of said non-display portion (2*a*).

4. A display lamp according to claim 3, wherein said pair of left- and right-side end LEDs (42, 43) respectively irradiate lights to those parts of said globe (5, 5A) which are respectively opposite to said right- and left-side end LEDs as separated from each other with the largest distance provided therebetween.

5. A display lamp according to any of claim 1 or 2, wherein said light source (4) comprises a center LED (41) which is disposed at the transverse center of said non-display portion (2*a*) and which irradiates light to the transverse center and its vicinity of said globe (5, 5A).

6. A display lamp according to any of claim 1 or 2, further comprising reflection means (82) for reflecting portions of the lights from said pair of left and right LEDs (42, 43) toward the transverse center and its vicinity of said globe (5, 5A).

7. A display lamp according to any of claim 1 or 2, further comprising reflection means (81) for reflecting portions of the lights from said pair of left and right LEDs (42, 43) toward those zones of said globe (5, 5A) which are located in the same sides with respect to said LEDs (42, 43) in the transverse direction.

8. A display lamp according to claim 7, wherein said reflection means (81, 82) is disposed on said non-display portion (2*a*).

9. A display lamp according to any of claim 6, wherein said reflection means (81, 82) is formed by the surface of a portion of a case (3) which supports said globe (5, 5A).

10. A display lamp according to claim 9, wherein said case (3) comprises a pair of end members (32*a*) which hold the upper and lower ends of said globe (5, 5A), and a post member (32*c*, 32*e*) which connects said pair of end members (32*a*) to each other, and said reflection means (81, 82) is formed on a surface of said post member (32*c*, 32*e*).

* * * * *